US005332274A

United States Patent [19]

Baumann

[11] Patent Number: 5,332,274

[45] Date of Patent: Jul. 26, 1994

[54] CONTAINER HANDLE AND CONTAINER

[76] Inventor: James A. Baumann, 16413 Grant Ave., Orland Park, Ill. 60462

[21] Appl. No.: 973,723

[22] Filed: Nov. 9, 1992

Related U.S. Application Data

[63] Continuation-in-part of Ser. No. 945,747, Sep. 16, 1992.

[51] Int. Cl.[5] ..... B65D 88/12

[52] U.S. Cl. ..... 294/68.3; 220/1.5

[58] Field of Search ..... 294/68.1, 68.3, 81.51, 294/81.54; 220/1.5

[56] References Cited

U.S. PATENT DOCUMENTS

| | | | |
|---|---|---|---|
| 1,802,888 | 4/1931 | Fitch | 294/68.3 X |
| 2,191,445 | 2/1940 | Armington | 220/1.5 |
| 2,457,841 | 1/1949 | Smith et al. . | |
| 2,478,192 | 8/1949 | Harker | 24/230.5 |
| 2,547,502 | 4/1951 | Smith et al. | 294/67 |
| 2,904,370 | 9/1959 | | 294/110 |
| 3,128,117 | 4/1964 | Abolins | 294/67 |
| 3,262,729 | 7/1966 | Willison et al. | 294/68.3 |
| 3,375,950 | 4/1968 | Chieger | 220/1.5 |
| 3,567,266 | 3/1971 | Bridge | 294/67 |
| 3,588,163 | 6/1971 | Wald | 294/68.3 |
| 4,358,145 | 11/1982 | Svensson | 294/81 |
| 4,728,234 | 3/1988 | Reynard | 410/82 |
| 4,854,807 | 8/1989 | Bishop | 414/498 |
| 4,968,080 | 11/1990 | Kerry | 294/81.2 |

FOREIGN PATENT DOCUMENTS

| | | |
|---|---|---|
| 0283121 | 9/1988 | European Pat. Off. . |
| 2197296 | 1/1990 | United Kingdom . |
| PCT/GB92/-00176 | 8/1992 | United Kingdom . |

*Primary Examiner*—Dean J. Kramer

[57] ABSTRACT

A handle for mounting on a container for use with a releasable latch mechanism having lower and upper engagement members, the container handle comprising, a body including a substantially vertical member having an outwardly facing surface having a lower engagable portion having a lower engagement surface and an upper engagable portion having an upper engagement surface, the lower and the upper engagement surfaces adapted for cooperating with the respective lower and upper engagement members of the latch mechanism for releasably gripping the handle.

22 Claims, 3 Drawing Sheets

52
C
62
68
60
70
56
66
64
58
72
54
B 88
84
86

82
94
96
92
52

12
66
74
68
64
118
114
104
116
70
72
60
112
118
118
76
142
12
144

78
A
144
142

126
99b
128
66
74
14
56
60
130
76
112
58
14

128
74
132
130
134
106
102
78
108
136
60
54

28
109
111
32
109a
111
110
110a
50

CONTAINER HANDLE AND CONTAINER

CROSS-REFERENCE TO RELATED APPLICATION

This application is a continuation-in-part of pending application Ser. No. 945,747, filed Sep. 16, 1992.

TECHNICAL FIELD

This invention relates to a container handle and container with handles, and particularly to a handle for mounting on a container for use with a releasable latch mechanism having lower and upper engagement members, the container handle comprising: a body including a substantially vertical member having an outwardly facing surface having a lower engagable portion having a lower engagement surface and an upper engagable portion having an upper engagement surface, the lower and the upper engagement surfaces adapted for cooperating with the respective lower and upper engagement members of the latch mechanism for releasably gripping the handle.

BACKGROUND OF THE INVENTION

The intermodal industry has been streamlining to meet shipper's demands for quality service. Equipment manufacturers, truck load carriers and railroad lines play important roles in this process of rationalization. Rationalization, in the intermodal industry, involves the process of optimizing routes, rate services and equipment.

Efforts to simplify and expedite handling for rail and truck carriers have been attempted in the past. There are on-going efforts to make universal trailers, containers and attachments therefor, to allow trucking companies, shippers and the railroad to work together to flourish, rather than compete.

The benchmark of intermodal service combines the road effectiveness of truck transport with the cost effectiveness of double-stacked rail transport. Service and price, not mode, are strong considerations for shippers. Shippers also have the following goals: on-time delivery, complete deliveries, reduced transit times to meet a predetermined order cycle schedule; reduced inventory with more inventory turns; and flexibility.

To simplify their trailer fleets, there is a trend for trucking companies to convert to larger containers, such as 48- and 53-foot trailers, in an effort to standardize and lower costs.

Improvements in intermodal transportation can effect ocean carriers, as well as rail and truckload carriers. Recently, intermodal traffic has become more dispersed, and less concentrated around the ports. Thus, there is an increased demand for efficient service and improved equipment. Trains used in intermodal operations are shorter. They are running more frequently and shorter lanes. Thus, there appears to be a need for larger, high cube trailers, which may some day replace the 40-foot ISO container as the standard for intermodal equipment.

Choosing the right mode for the right load in this competitive environment, is now becoming more important than ever. A shipper's delivery requirements are considered along with availability of shipment mode - over-the-road and intermodal. Equipment availability, train schedules, distances and how to balance freight lines are some of the factors to be considered. A problem voiced in the intermodal industry, is that there are to many non-standard equipment sizes and types, resulting in inefficiencies in loading, reduced productivity of dock personnel, and freight damage. Therefore, there is a need to standardize equipment and containers and attachments therefor, which can be utilized universally, efficiently and effectively.

There is also a need to allow railroads and other transportation modes to work together to develop efficiencies, such as with new equipment, scheduling techniques and the like to allow shippers to be able to choose transport products via railroad, truck or a combination of both, without losing productivity, while maximizing weight and cube advantages. Accordingly, new technologies are needed and being created, such as the container handle and container of the present invention, and hoisting equipment, that will expedite the transportation of containers and solve many of the problems plaguing this industry.

Efforts to expedite the handling of freight in cargo containerization or in arrangements for connecting containers and hoisting equipment, have been attempted in the past. To date, connecting mechanisms of satisfactory thinness have not been devised which substantially conform to wall or frame thickness of container walls and thus prevent or minimize intrusion into the pay load space of the container, or projection beyond the outer contour of the container. Thin connections are desirable to increase the cubic space available for the pay load, while also providing an efficient and effective means to handle a container and expedite the interactions with a hoist, for improved efficiency. A standard container handle and container is desirable in view of the trend toward larger containers.

A desirable pick-up arrangement for a container resides in cooperating construction of a container, container handles and hoisting implements which enable coupling of the container and the implement and which simplifies the frame construction of the container and avoids undesirable protrusions into the lading space of the container.

As the lengths of containers are extended, the handle is becoming increasingly important in terms of construction, ability to handle larger loads and maximizing cubic area for loading.

Accordingly, there is a need for a container handle and container arranged with such handles, that will minimize the cost, space encroachment, complexities of container and hoist equipment, construction, or weaknesses of container handles and container construction inherent in the devices and mechanisms presently known in the art.

It is therefore desirable to provide an improved container handle and container, which overcomes most if not all of the problems facing this and related industries.

SUMMARY OF THE INVENTION

This invention involves a container handle and container accompanied with such container handle. More particularly, the handle is utilized for mounting on a container, and is adapted for use with a releasable latch mechanism having lower and upper engagement members. The container handle includes a body including a substantially vertical member having an outwardly facing surface having a lower engageable portion having a lower engagement surface and an upper engageable portion having an upper engagement surface. The lower and upper engagement surfaces are adapted for cooperating with the respective lower and upper engagement members of the latch mechanism for releasably gripping the handle.

In a preferred embodiment, the upper engagement surface and the lower engagement surface are substantially vertically aligned with each other and between the outer and inner facing surfaces of the substantially vertical member, to minimize any undesirable moments therein.

Also in a preferred embodiment, the lower engagement surface provides a large rectangular area to receive the lower engagement member of the releasable latch mechanism for providing substantially concentric loading across such surface, for improved integrity, and minimization of any unwanted moments when loaded.

In a preferred embodiment, four container handles are coupled to a container at the sidewalls and header thereof. The thin container handle profile and container for use with the present handle, are constructed to provide a high cubic area, and low weight to maximize the pay load available to be transported.

The side latch interconnect system described herein in conjunction with the four fixed handles, provide increased structural assistance to the container, for increased durability and integrity, and allows for lower weight and thin wall construction of the container.

DESCRIPTION OF THE PREFERRED EMBODIMENT

Figure 1:
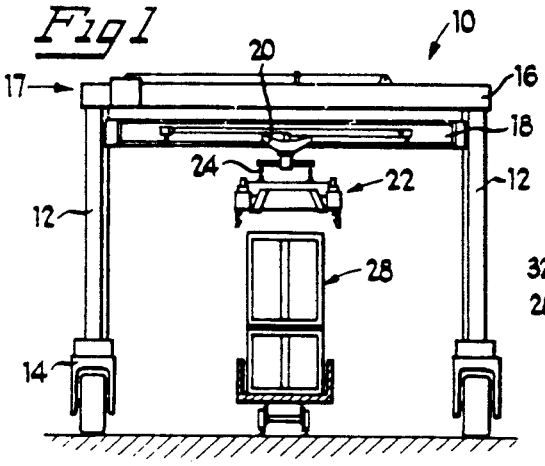
FIG. 1 is a front elevational view of a lifting apparatus in the form of a gantry crane accompanied with a side latch interconnect system capable of engaging a plurality of container handles attached to an upper side portion of a container or truck trailer, in accordance with the present invention.

Referring to FIG. 1, there is shown a lifting apparatus in the form of a gantry crane 10. The lifting apparatus 10 includes a plurality of interconnected horizontal and vertical beams to form an open-centered frame for straddling and transporting containers, truck trailers and the like.

The apparatus 10 includes upright corner columns 12 supported by pivotally attached wheel assemblies 14, with suitable drive means (now shown) for moving the apparatus 10 along a ground surface. The apparatus 10 further includes a plurality of horizontal beams, including lower and upper horizontal cross beams 15 and 16 connecting columns 12. The upper horizontal cross beams 16 defines part of an upper portion 17 of apparatus 10. In one embodiment, there are four beams 16 coupled to the front and rear columns 12 and there are two lower horizontal cross beams 15 adjacent the wheel assemblies 14, connecting the front and rear columns on each side of apparatus 10. As shown in FIG. 1, the apparatus 10 can be readily maneuvered over a stack of containers, for lifting and transporting containers to various locations as needed.

In FIG. 1, the apparatus 10 further includes an elevatable horizontal stabilizer beam 18 movably coupled to the upper portion 17, for allowing a load such as a container to be raised or lowered. Coupled to the stabilizer beam 18 is a trolley mechanism 20, for allowing horizontal or lateral movement thereof. The trolley mechanism 20 includes a side latch interconnect system 22 coupled by connection structure 24 in the form of a direct hanging chain 24 in FIG. 1.

The apparatus 10 is particularly adapted for movement along a transportation work place, such as, a plurality of roadways, railroad tracks and like, so as to enable intermodal transfer of trailers and containers from trucks to railroad freight cars or vice versa and the like.

Figure 2:
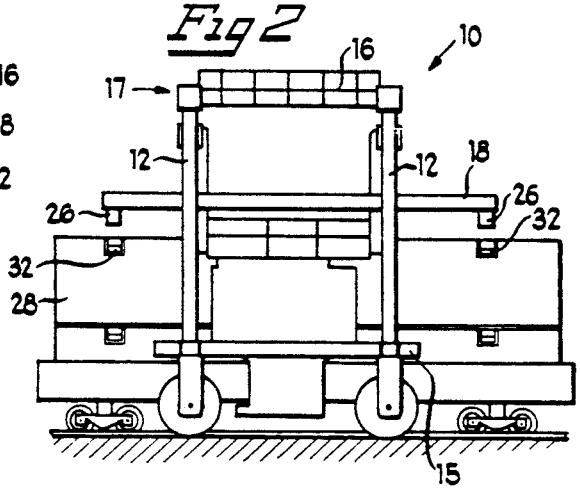
FIG. 2 is a side elevational view of the lifting apparatus and two stacked containers supported by a railroad cradle car, the containers having container handles attached to an upper side portion thereof as shown in FIG. 1, and in accordance with the present invention.

In FIG. 2, the side latch interconnect system 22 includes two tandem transverse releasable latch mechanisms 26 for positioning and placement above and adjacent to the roof or header of a container 28.

Figure 3:
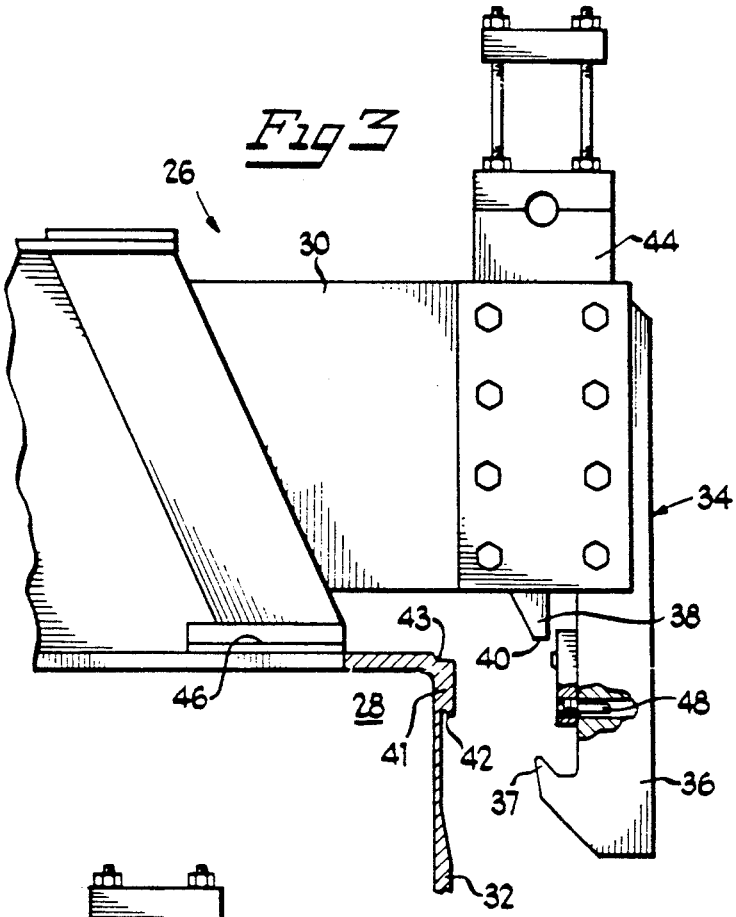
FIG. 3 is a partial, enlarged front elevational view of the side latch interconnect system and a cross-sectional view of the container handle in FIGS. 1 and 2, showing a releasable latch mechanism in a disengaged position with respect to the container handle in accordance with the present invention.

Referring to FIG. 3, each releasable latch mechanism 26 includes at each distal end an extendable, preferably telescopic, arm member 30 for movement laterally outwardly or inwardly, substantially in a horizontal direction, beyond the width of the container 28. In FIG. 3, the latch mechanism 26 is shown in a disengaged position, and in FIG. 4, in an engaged position with respect to a container handle 32, which is suitably secured and anchored to container 28.

Figure 4:
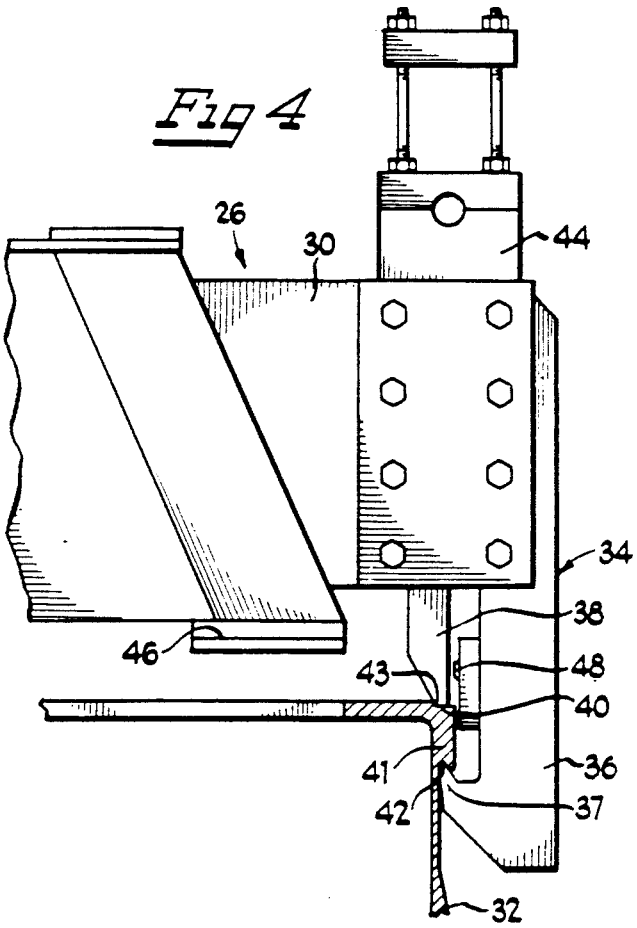
FIG. 4 is a partial, enlarged front elevational view of the side latch interconnect system and a cross-sectional view of the container handle in FIGS. 1 and 2, showing the releasable latch mechanism gripably engaged with and securely connected to the container handle in accordance with the present invention.

In FIGS. 3 and 4, the container handle 32 includes an engageable portion 41 comprising a lower engageable portion 42 and an upper engageable portion, as described more fully below.

In FIGS. 3 and 4, each releasable latch mechanism 26 includes a generally backward "L-shaped" arm 34 which is capable of being moved into and out of engagement with the container handle 32. The arm 34 includes a lower engagable member 36 with an outer end portion 37. In one embodiment, the end portion 37 forms an upwardly projecting hook, which is configured to cooperate with and at least partially complementary with the lower engageable portion 42 of the container handle 32, to facilitate the coupling and decoupling of the latch mechanism 26 with the container handle 32 and the container 28 accompanied with the handle 32.

The latch mechanism 26 further includes an upper engageable member 38 in the form of a vice bar having a lower end 40 for engagement with an upper engagable portion 43 of the container handle 32, as described in further detail below. The upper engageable member 38 of the latch mechanism 26 and the upper engageable portion 43 of the container handle 32 are configured to cooperate with and be at least partially complementary with each other, to facilitate coupling and decoupling of the latch mechanism 26 with the container handle 32.

The upper engagement member 38 is operable in a vertical direction, upwardly and downwardly, by a power means 44, preferably in the form of a hydraulic cylinder or other suitable means, so as to apply a vector force downwardly against the upper engagable portion 43 of the container handle 32, for secure engagement of the latch mechanism 26 with the container handle 32.

In one embodiment, the lower and upper engageable portions 42 and 43 of container handle 32 are substantially complementary with respect to the lower and upper engagement members 36 and 38 for improved interconnection and releasable coupling and decoupling therebetween, respectively.

Figures 5, 6, 7, 8, 9, 10, 13, 14:
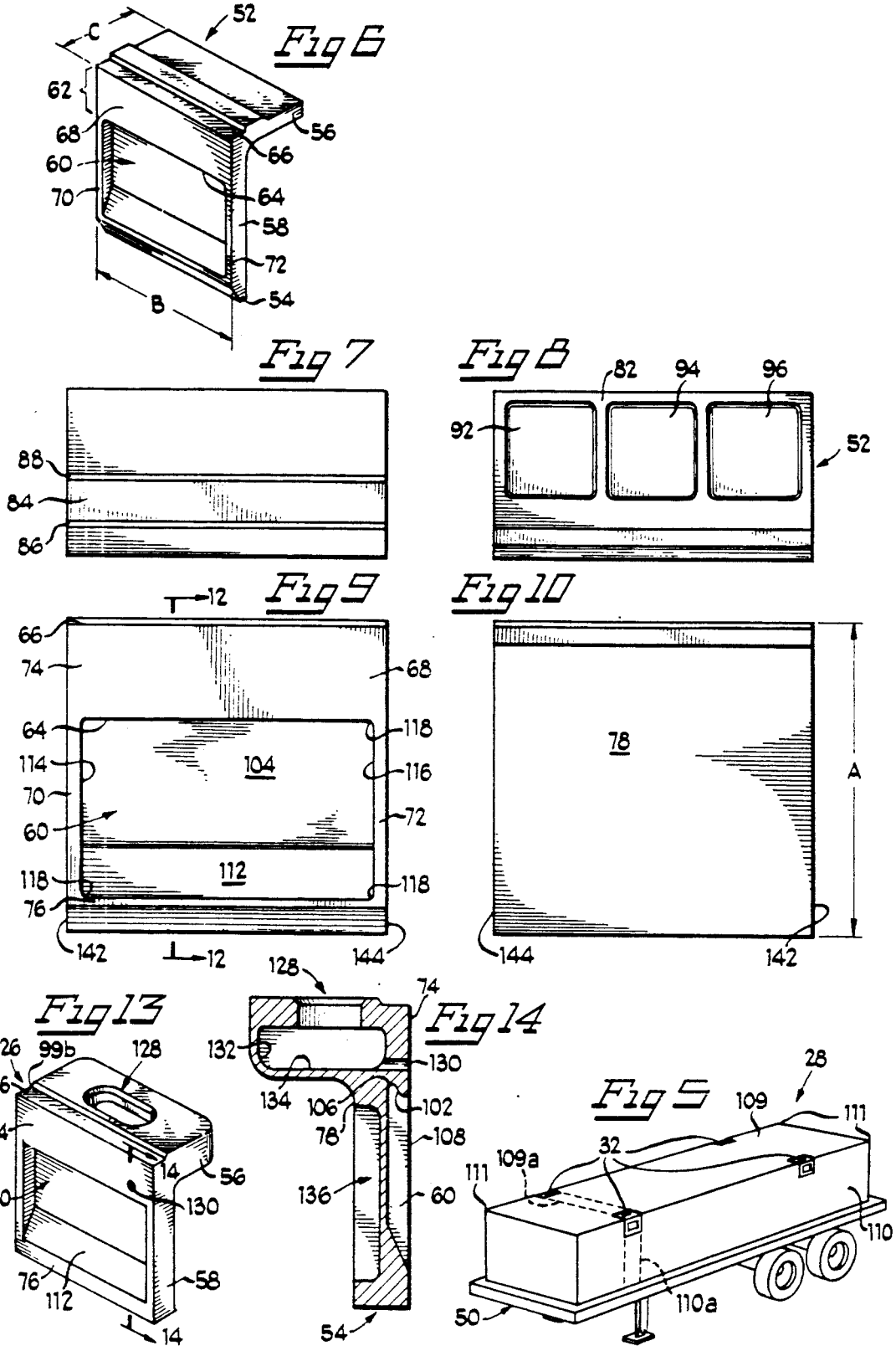
FIG. 5 is a perspective view of a removable container on a truck chassis, accompanied with a plurality of container handles in normal use in accordance with the present invention.
FIG. 6 is an enlarged perspective view of the container handle of the present invention.
FIG. 7 is a top plan view of the container handle shown in FIG. 6 in accordance with the present invention.
FIG. 8 is a bottom plan view of the container handle shown in FIG. 6 in accordance with the present invention.
FIG. 9 is a front elevational view of the container handle shown in FIG. 6 in accordance with the present invention.
FIG. 10 is a rear elevational view of the container handle shown in FIG. 6 in accordance with the present invention.
FIG. 13 is an enlarged perspective view of an alternate embodiment of a container handle accompanied with a top pocket in accordance with the present invention.
FIG. 14 is a sectional view of the container handle of FIG. 13 taken along the lines 14—14 of FIG. 13 in accordance with the present invention.

In operation, the apparatus 10 is suitably positioned over and about a truck trailer or cargo container 28, as shown in FIG. 2. Next, the stabilizer beam 18 is adjusted vertically to position each latch mechanism 26 about and in proximity to the container handles 32, preferably at four upper side locations on the container 28. The extendable arm members 30 are typically in an extended position extending outwardly beyond the width or sidewalls of the container 28 as shown in FIG. 3. The stabilizer 18 is then moved vertically downwardly until a mounting mechanism 46 senses or contacts the header or roof of the container 28, thereby positioning the interconnect system 22 with the latch mechanism 26 in a service position, as shown in FIG. 3. The extendable arms members 30 are then retracted or moved horizontally inwardly toward the container handle 32 as appropriate. In one embodiment, an alignment sensor 48 on FIG. 3, positions the lower engagement member 36 end portion 37 adjacent and just below the lower engagable portion 43 of the container handle 32, as shown in FIG. 4. Thereafter, the upper engagement member 38 is moved downwardly against the upper engagable portion 43 of the container handle 32, thereby simultaneously causing the lower engagement member 36 to be drawn upwardly into contact with the lower engagable portion 42 of the container handle 32, as shown in FIG. 4. This results in a vertical force pressing downwardly on the upper engagable portion 43 of the container handle 32 and a substantially equal vertical force pressing upwardly on the lower engagable portion 42, from the upper and lower engagement members 38 and 36, respectively, so as to hold the container handle 32 in a vise grip-like connection. In one embodiment, this occurs at, at least two locations and preferably at four external locations, as shown in FIG. 5. Consequently, the apparatus 10 is capable of lifting and transporting a truck trailer or container 28 from its side, and placing it on or lifting it off another container, railroad car or the like, as shown in FIG. 1.

In FIG. 5, a removable container 28 is shown, including a plurality of container handles 32 mounted at predetermined locations on the container 28 and spaced apart so as to provide a pre-determined span length therebetween. In one embodiment, the container 28 is removable from a truck chassis. The container handle 32 of the instant invention can be utilized in a wide variety of containers, and are particularly adapted for use with long containers, such as those about 48 or 53 feet long for larger pay loads. The handles 32 are particularly adapted for lighter weight containers, for fuel savings over the road, similar to the airline industry. Similarly, the span lengths can vary widely. In one embodiment, the span length between the handles 32 is about 40 feet for improved and efficient transporting thereof. The center of the container defines and axial axis with the container handle 32 being in alignment with such axis.

Figure 11:
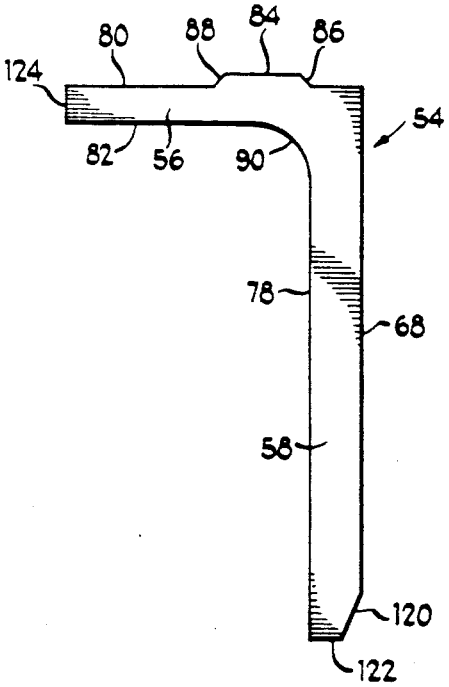
FIG. 11 is a side elevational view of the left side of the container handle shown in FIG. 6, the right side being a mirror image of the left side, in accordance with the present invention.

In the embodiment shown in FIG. 6, a container handle 52 is shown which includes a body 54 including a substantially horizontal flange member 56 and a substantially vertical flange member 58 having a recess 60. The substantially horizontal member 56 and the vertical member 58 are connected by an intermediate engagable portion 62, having a lower and an upper engagable portion 63 and 65 with a lower and an upper engagement surface 64 and 66, respectively, for allowing a vise-grip like or C-clamp like gripable engagement thereof. As best shown in FIG. 11, the body 54 profile, is substantially narrow and includes an inverted L-shaped member, to minimize the space necessary for use with a container 28, thereby providing minimal intrusion into the interior of a container, resulting in maximizing the cubic space available for loading a container.

Figure 12:
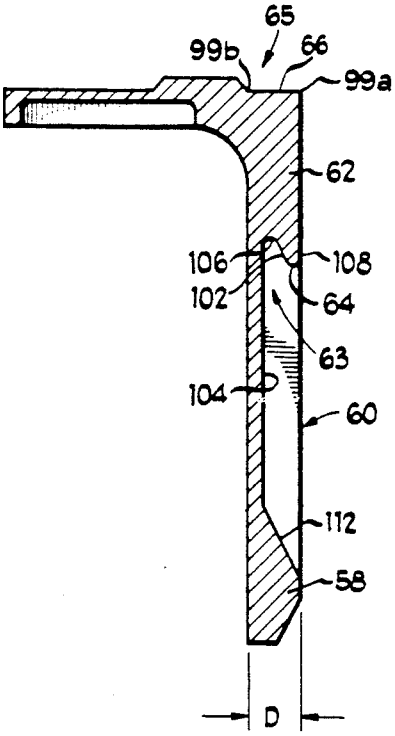
FIG. 12 is a sectional view of the container handle shown in FIG. 6, taken along the lines 12—12 of FIG. 9 in accordance with the present invention.

In a preferred embodiment, the container handle 32 in FIG. 3, item 52 in FIG. 6 or item 126 in FIG. 13, is mounted on container 28 for use with a releasable latch mechanism 26 having lower and upper engagement members 36 and 38. In FIG. 6, the container handle 52 includes an aerodynamic body 54 including a substantially vertical member 58 having an outwardly facing surface 68 having a lower engagable portion 63 having a lower engagement surface 64 and an upper engagable portion 65 having an upper engagement surface 66, the lower and the upper engagement surfaces 64 and 66 are configured and adapted for cooperating with the respective lower and upper engagement members 36 and 38 of the releasable latch mechanism 26 for releasably gripping, vice-gripping, latching or coupling of the container handle 52. The container handle 52 is configured with a narrow profile to minimize intrusion into the interior of a container, thereby maximizing the cubic area available for loading, as illustrated in FIGS. 3, 11 and 12. More particularly, the upper engageable portion 65 with a horizontal flange member 56 and the vertical member 58 with the lower engageable portion 63, are configured to minimize intrusion into the container 28 in FIG. 5.

The container handle can be manufactured in various ways, such as from machining a plate, forging or casting. In a preferred embodiment, the container handle of this invention is integral or cast by pouring a liquid into a mold and allowing it to harden, preferably a metallic material is used. It is believed that a container handle 52 made by casting, forms an integral, compact and narrow profile of the desired geometry with the necessary integrity and properties to withstand substantial axial stresses, torsional stresses and bending moment stresses and the like, with an improved grain structure, yet minimizes the profile necessary to minimize intrusion into the interior of a container.

Referring to FIG. 9, the vertical member 58 includes an outwardly facing surface 68 including re-enforcing vertical guides 70 and 72 on either side of the recess 60, when the recess 60 is in the form of a rectangular pocket. In one embodiment, the recess 60 as well as the outwardly facing surface 68 on the top and bottom, and guides and 70 and 72 on the sides have substantially the same geometric shape, such as rectangular, for a smooth transition of the tension or pulling forces when lifting a heavy load in a container. The recess 60 provides a wide area or large target profile for an operator to aim the lower engagement member 36 of the latch mechanism 26, for facilitating handling. In FIG. 9, the outwardly facing surface 68 further includes an upper and a lower portion 74 and 76, as well as the left and right guides 70 and 72. The guides 70 and 72 are configured to help an operator interconnect the latch mechanism 26 to the container handle 52.

Referring to FIG. 11, opposite the outwardly facing surface 68, is an inwardly facing surface 78. Similarly, the horizontal member 56 includes an upwardly facing surface 80 and downwardly facing surface 82 opposite thereof. In FIG. 9, the container handles 52 includes left and right sides 142 and 144 defining the left and right boundaries thereof.

In one embodiment, the horizontal member 56 of the upper engageable portion 65 includes an upwardly facing elongated abutment 84 extending longitudinally in alignment with and parallel to the longitudinal axis B, in FIG. 6. The abutment 84 includes an outer inclined surface 86 and an opposite inner inclined surface 88, as shown in FIG. 11. The abutment 84, and particularly the outer inclined surface 86, are configured to direct and align the upper engagement member 38 of the latch mechanism 26 with the upper engagement surface 66, for forming a secure key engagement therebetween, and for proper gripping of the handle 52 between lower and upper engagement surfaces 64 and 66, thereby allowing the lower and upper engagement members 36 and 38 to apply equal and opposite vertically aligned vector forces for secure clamping to lower and upper engagement surfaces 64 and 66, respectively.

The inclination of surface 86 with respect to upper engagement surface 66 can vary widely, preferably from about 90° to about 180°, and most preferably from about 125° to about 145°; for efficient alignment and a smooth transition of forces when under load. Also preferred, the inner inclined surface 88 is a mirror image of surface 86 for uniformity of the abutment 84 along and across the upper engageable portion 65.

Opposite the abutment 84 is a curved, concave and linear section 90 for a smooth transition from the downwardly facing section 82 and inwardly facing surface 78 of the body 54, for a smooth transition of forces and structure whether under load or not.

In one embodiment, the downwardly facing surface 82 includes first, second and third rectangular indentations 92, 94 and 96, to minimize the overall weight of the container handle 52 in FIG. 8.

The engagable portion 62 in FIG. 12, is configured to include an upper engagement surface 66, a lower engagement surface 64 opposite and vertically aligned with the upper engagement surface 66. In addition, the lower engagement surface 64 is adjacent to the recess 60. The lower and upper engagement surfaces 64 and 66 define a male member on the outwardly facing surface 68 on vertical member 58, for facilitating and improving gripable engagement thereof and therebetween. The male member extends horizontally along the vertical member 58, as shown in FIG. 9, to provide an extended, linear and horizontal contact area for connection with the latch mechanism 26. The upper engagement surface 66 further includes an outer section 99*a* in the form of an apex and an inner section 99*b* in FIG. 12.

In a preferred embodiment, the container handle 52 is suitably connected to a container 32 where the sidewall and header meet. In such embodiment, the lower and upper engagement surfaces 64 and 66 are substantially vertically aligned with a sidewall with or without an appropriate container framing means, so that when container handle 52 is being utilized to lift a container, substantially most of the tension or pulling forces are substantially vertically aligned through and parallel to the vertical member 58 and sidewall and/or framing means. Preferably, most of the pulling forces run vertically through the container handle 52, defined as between the outwardly and inwardly facing surfaces 68 and 78 and the left and right sides 142 and 144, and most preferably through the lower engagement surface 64 in proximity to the transition section 106, to substantially minimize any unwanted moments.

The lower engagement surface 64 is configured to provide a large area for substantially concentric vertical loading, when lifting a load, thereby minimizing any undesirable bending moments. This allows a manufacturer to make a lighter weight container with substantial integrity, which requires less, interconnecting structure for fuel economy.

In one embodiment, the lower engagement surface 64 includes an inclined surface 102 adjacent to a base 104 of the recess 60. The lower engagement surface 64 and the base 104 meet to form an inner concave transition section 106, as shown in FIG. 12. In one embodiment, the inner transition section 106 is substantially linear and horizontal along a substantial portion of the vertical member 58.

In one embodiment, the concave section 106, provides a linear and horizontal pick point for engagement with a complementary lower end 42 of the lower engagement member 36 of the latch mechanism 26. The lower engagement surface 64 further includes an outer-convex transition section 108, which is substantially linear and horizontal to provide a smooth surface for receiving or catching a lifting mechanism, and minimizing the possibility of damage to the section 108 when contacting a latch mechanism 26.

The term moment, as used herein, has its conventional meaning in mechanical engineering. Briefly, a moment refers to an externally applied force applied not in substantial alignment with a beam or other similar structure, such as a force applied offset or at an angle with respect to the beam and the neutral axis thereof. The lower engagement surface 64 of the container handle 52 provides a surface for lifting the handle 52, preferably with a container 28, which is in substantial vertical alignment with the vertical member 58, to minimize any moments. This allows the container to be made more cost effectively, lighter and with less supporting structure. More particularly, it is believed that the unwanted bending moments are minimized when the lower and upper engagement surfaces 64 and 66 are interconnected with latch mechanism 26, and the supporting forces when loaded run through the lower engagement surface 64 and run parallel to the vertical member 58. Furthermore, the side latch interconnect system described herein in conjunction with the four fixed handles, provide increased structural assistance to the container, for increased durability and integrity, and allows for lower weight and thin wall construction of the container.

In engineering, sections where the bending moment is zero, are called points of inflection or contraflecture, or can be located by equating the equation for moments to zero at such sections. If a beam must be spliced, the splice should be located at or near a point of inflection if there is one to minimize unwanted twisting forces or bending moments.

It is believed that the horizontal member 56 has an inflection point substantially aligned with and parallel to the header 109 and/or framing 109*a*, and the vertical member 58 has a contraflecture point aligned with and parallel to a sidewall 110 and/or framing 110*a* in FIG. 5. Thus, when loaded the container is supported vertically by the lower and upper engagement surfaces 64 and 66, resulting in minimizing unwanted moments to the handle 52 as well as the container, resulting in a longer useful life for the handle 52 and container. Similarly, the horizontal member 56 is configured to minimize any unwanted moments.

Advantageously, the lower engagement surface 64 provides a wide and linear concentricly loaded surface for lifting the container handle 52. It is believed that unwanted moments are minimized when the upper engagement member 38 of the latch mechanism 26 is latched to handle 52.

As should be understood by those skilled in the art, the container handle 52 of the instant invention, can be utilized for varying types of containers, but is particularly adapted to being utilized in conjunction with removable containers attachable to truck chassis and/or railroad cars, and the like in FIGS. 1 and 5. Also, as should be understood, in one embodiment, the container 28 can have an open top for material handling, for example.

In the embodiment shown in FIG. 5, a plurality of container handles 32 are coupled to the header 109 and sidewalls 110 of container 28, in proximity to the upper corners 111 thereof to provide a predetermined distance therebetween. Preferably, four container handles 32 are carefully coupled to and in alignment with the header 109 and sidewalls 110 or horizontal and vertical framing posts 109*a* and 110*b* of container 28, respectively, as shown in phantom in FIG. 5. The framing 109*a* and 110*a* are interconnected with other framing of the container (not shown) to provide the necessary integrity. The container handles 52 are spaced apart to provide a fixed span length therebetween to facilitate handling and engagement thereof. Each of the container handles 32 are adapted for use with the releasable latch mechanism 26 having lower and upper engagement members 36 and 38, the upper and the lower engagement surfaces 66 and 64 of the container handles 32, are configured and adapted for cooperating with the respective upper and lower engagement members 38 and 36 of the latch mechanism 26 for releasably gripping the container handles 32 and container 28 in FIG. 5. The transition section 106 is aligned with a neutral vertical axis aligned with A in FIG. 10, defined as running through the middle of vertical member 58. In a preferred embodiment, the neutral axis is also aligned with the sidewalls 110 and/or framing 110*a*, for substantially minimizing unwanted bending moments, thereby minimizing distortions to the container upon lifting and extending its life.

Referring to FIG. 9, the pocket 60 further includes a lower inclined section 112 and side sections 114 and 116, the section 112 helps to direct the lower engagement member 36 of the latch mechanism 26 toward the base 104 of the recess 60 for proper alignment, thereby facilitating engagement. Once aligned, the side sections 114 and 116 of recess 60 and guides 70 and 72 contribute to keeping the latch mechanism 36 properly aligned until gripable engagement of the engageable portion 62 is completed. In one embodiment, the corners 118 are curved to provide a smooth transition of forces when being utilized to pick up heavy loads.

In FIG. 11, the vertical member 58 further includes an inclined section 120 and an end section 122 and the horizontal member 56 includes an end section 124, for suitable connection to the framing of a container 28 sidewall and header, respectively.

The container handle 52 is configured to align the vertical member 58 with the sidewalls 110 and the upper engageable portion 65 with the header 109. In a preferred embodiment, the lower and upper engagement surfaces 64 and 66 and the framing 110*a* are coupled and aligned to minimize unwanted moments when utilizing handle 52 by lifting the container 28. This is accomplished by vertically aligning the lower and upper engagement surfaces 64 and 66 with the framing 109*a* of sidewalls 110 so that the tension or pulling forces when under load or when container 28 is picked up, run through and are aligned vertically with vertical member 58, framing 109*a* and sidewalls 110, and thereby minimizing unwanted moments when lifting container handle 52.

In one embodiment, the container handles of the present invention are substantially coextensive with the container 28 as shown in FIGS. 3 and 5. In a preferred embodiment, the horizontal member 56 is coextensive with and slightly recessed in the header 109 and the vertical member 58 is coextensive with and slightly recessed in the sidewalls 110, to provide an aesthetically pleasing aerodynamic container 28 design, accompanied with readily accessible handles.

The container handles of the instant invention can be used in a wide variety of applications, to simplify and improve the effectiveness of transporting containers, while minimizing intrusion within the containers, thereby maximizing the cubic area for loading the container.

Referring to FIG. 13, container handle 126 is shown, with an elongated rectangular aperture 128 aligned along an axial axis, on horizontal member 56. The aperture 128 is particularly adapted to receiving a locking device, such as an inter box connector for locking adjacent containers on a railroad car, as shown in FIG. 1.

The container handle 126 in FIG. 13 is substantially similar to the container handles 32 and 52 previously discussed. Thus, the same identification numbers as utilized to identify the same elements in container handles 32 and 52 are used for container handle 126. The container handle 126 in FIG. 14, further includes a drainage aperture 130, extending from the aperture 128 to the outwardly facing surface 68 of the upper portion 74, for draining water, dirt, melting snow and the like. In FIG. 14, the aperture 128 includes sidewall 132 and a base 134. In one embodiment, the inwardly facing surface 78 of the vertical member 58 includes a first, second and third elongated and rectangular indentation 136, 138 and 140, extending vertically, for minimizing the weight of body 54 (only 136 is shown in FIG. 14).

The profile and dimensions of the container handle 52 of the instant invention can vary widely.

For example, in one embodiment, the height parallel to a vertical axis A, in FIG. 10 ranges from about 14 to about 9 inches, preferably about 11.5, the width B in FIG. 6 is at least about 5 inches, preferably about 12 or 8 inches, with a recess width ranging from about 14 inches to about 4 inches, preferably about 11 or 7 inches, and the depth along horizontal axis C in FIG. 6 can vary widely, for example at least about 1 inch, preferably about 6 inches, and a thickness D in FIG. 12 of the vertical member of about three inches or less, preferably about 1 inch. The line identified as B in FIG. 6, as used herein, defines a longitudinal axis. As should be understood by those skilled in the art, the dimensions can be varied while still being within the scope of this invention.

The weight of the container handle 52 can vary widely based on material selection and dimensions. In one embodiment, the weight is at least about 5 lbs., preferably about 20 to 30 lbs. for steel, for minimizing the weight while maximizing the integrity.

The material utilized to make the container handle 52 can vary widely. The material however needs to be able to withstand the harsh environments and substantial loads and forces it will be exposed to. In a preferred embodiment, the material to make the container handle 52 comprises a metallic material having at least the following mechanical and chemical properties as specified in ASTM A-27, with minimum mechanical properties of Tensile: 70 KSI, and Yield: 40 KSI, or ASTM A-36, for structural integrity and a long useful life. As should be understood by those skilled in the art, other materials can be utilized, which meet or exceed these properties.

The metallic material utilized to make the container handle 52 can vary widely. In one embodiment, the metallic material includes a chemical composition with at least one member of the group consisting of carbon, manganese, silicon, sulfur and phosphorus and combinations thereof, preferably all are utilized for the desired properties, such as durability, structural integrity, and a long useful life. Preferably, the container handle 52 is cast in a mold with the above components, to form the desired geometry with a narrow profile and structural integrity.

EXAMPLE

Four container handles, as shown in FIG. 6, were coupled to a 53 foot long container, as shown in FIG. 5. The handles on each sidewall of the container had a nominal 40 foot span therebetween, and were spaced equi-distances intermediately inwardly about six and one half feet from the upper corners of the sidewalls. The horizontal and vertical members 56 and 58 were securely coupled to the sidewall and header framing 110*a* and 109*a*, respectively. These handles were tested to demonstrate their capabilities.

The handles were made of steel having the mechanical specifications in ASTM A-36. The handles had the following dimensions: the height A equaled 11.5 inches; the width B equaled 8 inches; the depth C equaled 6 inches; and the thickness D equaled 1 inch, as shown in the figures.

A lifting apparatus 10 in the form of a gantry crane similar to that in FIGS. 1 and 2, was positioned to straddle over the container accompanied with four handles. The crane used was a Translift, model 1000R rubber tired gantry crane. The gantry crane included four upright columns, wheel assemblies attached to each, cross beams, an upper portion, an elevatable horizontal stabilizer beam, and a trolley mechanism was coupled to the stabilization beam for lateral movement thereof. The trolley mechanism included a side latch interconnect system coupled by direct hanging chains.

The side latch interconnect system included four releasable latch mechanisms, two in tandem in the front and two in the rear spaced and adapted to be interconnected with the handles in FIG. 5. Each latch mechanism included at each distal end a telescopically extendable arm member for movement laterally inwardly and outwardly, as shown in FIGS. 3 and 4. Each latch mechanism included a lower engagable member with an outer end portion and an upper engagable member, as more fully described previously.

The container handles were tested to determine their durability. The container accompanied with four handles was lifted in the following multi-step method. First, the side latch interconnect system was positioned appropriately so that the four releasable latch mechanisms were in proximity to the four handles, as shown in FIGS. 3 and 5. Second, each of the extendable latch members clamped, squeezed or were retracted so that the end portion contacted the container handle. Third, each of the upper engagement members were moved downwardly to apply a vector force to apply a vice-like engagement, securely holding the engageable portion of the handle as shown in FIG. 4. Fourth, the container was lifted by elevating the stabilizer beam. Fifth, the container was trolleyed laterally in a horizontal direction. Sixth, the container was lowered and the vicing force, in step three was released. Seventh, the handles were unclamped, by extending the latch member outwardly and laterally away from the handles.

This multi-step method defines one cycle. The four container handles were exposed to over 2,500 of these cycles, simultaneously by lifting the container. The container handles were visually inspected after the first 1,000 cycles and again, after 2,500 cycles. The last 2,000 cycles were loaded with a pay load weighing 47,700 lbs. The container weighed 9,000 lbs.

Further, the container was dragged, laterally bumped into a rail car, gantryed forward and backward, inclined severely raising one side more than the other, and lifted with a chassis weighing 6,380 lbs, with the pay load and container, totalling over 63,000 lbs. to simulate and exceed field conditions. During the test, no handle failures were observed and the handle and latch mechanism interacted as designed. After both inspections, no stress cracks or abnormal wear of the handles were observed, only normal wear and abrasions were found and burnishings were observed in the recess.

During a normal life for these handles, they are expected to be exposed to between 1,000 to 1,500 lift cycles over about 10 to 12 years of service. The handles were field proven and exceeded their operational requirements. The handles were exposed to and withstood more lift cycles than would normally be anticipated in their life.

Although various embodiments of this invention have been shown and described, it is to be understood that various modifications and substitutions as well as rearrangements and combinations of the preceding embodiments can be made by those skilled in the art without departing from the novel spirit and scope of this invention.

I claim:

1. A handle for mounting on a container for use with a releasable latch mechanism, the container handle comprising, an integral body including a substantially horizontal member and a substantially vertical member having an outwardly facing surface having a lower engagable portion having a lower engagement surface and an upper engagable portion having an upper engagement surface;

said outwardly facing surface facing outwardly away from the substantially vertical member further including side target means for releasably receiving a latch mechanism from a side in a substantially inwardly direction with respect to the substantially vertical member defined by a recess, said side target means being substantially centrally located on said outwardly facing surface including a plurality of communicating boundaries including (i) an upper boundary defined by said lower engagement surface, (ii) a substantially planar base section of the recess and (iii) side boundaries defined by side sections, and said boundaries being located substantially within the substantially vertical member of the body thereby allowing handling from a side.

2. The container handle of claim 1, wherein said upper engagable portion includes an abutment surface adjacent the upper engagement surface and extending across at least a portion thereof.

3. The container handle of claim 1, wherein said integral body includes a substantially narrow profile.

4. The container handle of claim 1, wherein said upper engagement surface and said lower engagement surface are substantially vertically aligned with each other and between the outer and an inner facing surface of said substantially vertical member.

5. The container handle of claim 1, wherein said lower engagement surface is substantially inclined, and includes a substantially linear and concave transition section substantially centered between the outer facing surface and an inner facing surface of the substantially vertical member of the body.

6. The container handle of claim 1, wherein a plurality of said container handles are mounted on a container.

7. The container handle of claim 6, wherein a container having sidewalls, end walls and a header, wherein a plurality of said container handles are coupled to each side wall in proximity to the header.

8. A handle for a container comprising, an integral body including a substantially horizontal member and a substantially vertical member including an outwardly facing surface having a pocket means, facing away from the outwardly facing surface, for allowing handling from a side said substantially horizontal member and said substantially vertical member being connected by engagable means for allowing gripable engagement thereof on said outwardly facing surface;

said engagable means including an upper engagable portion including an upper engagement surface, and a lower engagable portion including a lower engagement surface opposite said upper engagement surface and aligned therewith, said upper and said lower engagement surfaces defining an outwardly facing male member for gripable engagement thereof, said pocket means being substantially centrally located on said outwardly facing surface including boundary means including (i) an upper boundary defined by the lower engagement surface; (ii) a substantially planar base section of the pocket means and (iii) side boundaries, being positioned substantially below said outwardly facing male member, and said boundary means being located substantially within the substantially vertical member of the body; and substantially vertical reinforcing guides adjacent to and positioned outside of said side boundaries.

9. The container handle of claim 8, wherein said lower engagement surface and a base of said pocket means meet to form a gradual transition section therebetween.

10. The container handle of claim 9, wherein said transition section extends substantially horizontally across at least a portion of said substantially vertical member.

11. The container handle of claim 8, wherein said outwardly facing male member is elongated and extends substantially horizontally across most of the substantially vertical member.

12. The container handle of claim 8, wherein said horizontal member includes receptacle means for receiving a locking device.

13. The container handle of claim 8 wherein the side view of said body is substantially an inverted L-shaped member.

14. The container handle of claim 8, wherein a plurality of container handles are positioned substantially adjacent to at least side walls and a header of a container.

15. The container handle of claim 8, wherein said upper engagement surface and said lower engagement surface are between said outwardly facing surface and an inwardly facing surface of said substantially vertical member.

16. The container handle of claim 8, wherein said lower engagement surface includes a substantially inclined surface and a concave transition section spaced inwardly thereof adjacent a base of said pocket means.

17. The container handle of claim 16, wherein said concave transition section is substantially linear, and said concave transition section and said upper engagement surface are vertically aligned on the substantially vertical member.

18. The container handle of claim 17, wherein said concave transition section defines an upwardly pointing apex defining a pick point vertically aligned with said upper engagement surface of said vertical member.

19. A container for use with a releasable latch mechanism having lower and upper engagement members, the container comprising:

a plurality of side walls and end walls and a header; and a plurality of handle means coupled to said side walls in proximity to said header on said container and each said handle means being spaced apart so as to provide fixed span lengths therebetween, each handle means comprising a body including a substantially vertical member having an outwardly facing surface having a lower engagable portion having a lower engagement surface and an upper engagable portion having an upper engagement surface, said upper engagement surface further including an outwardly extending abutment means for directing and aligning the upper engagement member of the latch mechanism with the upper engagement surface, for forming a secure gripping of the handle means between the lower and the upper engagement surfaces, thereby allowing the lower and upper engagement members to apply equal and opposite vertically aligned vector force for secure clamping to the lower and upper engagement surfaces, said outwardly facing surface further including side target means for releasably receiving a latching mechanism, defined by a recess including an upper boundary defined by the lower engagement surface and side boundaries.

20. A container as claimed in claim 19 wherein said outwardly facing surface and said upper engagement surface of said handle means are coextensive with said side walls and said header of said container, respectively.

21. A handle for a container comprising, a body including a substantially horizontal member and a substantially vertical member including an outwardly facing surface having a pocket;

said substantially horizontal member and said substantially vertical member being connected by engagable means for allowing gripable engagement thereof on said outwardly facing surface, said horizontal member include receptacle means for receiving a locking device;

said engagable means including an upper engagable portion including an upper engagement surface, and a lower engagable portion including a lower engagement surface opposite thereof and aligned therewith, said upper and said lower engagement surfaces defining an outwardly facing male member for gripable engagement thereof.

22. The container handle of claim 21, wherein the body is integral and is substantially an inverted L-shaped member.

* * * * *